US007399734B2

(12) United States Patent
Grabowski et al.

(10) Patent No.: US 7,399,734 B2
(45) Date of Patent: Jul. 15, 2008

(54) POLYSILOXANE ADDITIVES FOR LUBRICANTS AND FUELS

(75) Inventors: Wojciech Grabowski, Gland (CH); Cyril A. Migdal, Pleasant Valley, NY (US); Stephen Hull, Chorleywood (GB)

(73) Assignee: Crompton Corporation, Middlebury, CT (US)

( * ) Notice: Subject to any disclaimer, the term of this patent is extended or adjusted under 35 U.S.C. 154(b) by 668 days.

(21) Appl. No.: 10/892,610

(22) Filed: Jul. 16, 2004
(Under 37 CFR 1.47)

(65) Prior Publication Data

US 2005/0176594 A1 Aug. 11, 2005

Related U.S. Application Data

(60) Provisional application No. 60/489,688, filed on Jul. 22, 2003.

(51) Int. Cl.
*C10M 169/04* (2006.01)
*C10L 1/28* (2006.01)

(52) U.S. Cl. ..... 508/208; 508/215; 44/320

(58) Field of Classification Search ..... 508/208, 508/215; 44/320
See application file for complete search history.

(56) References Cited

U.S. PATENT DOCUMENTS

| | | | | | |
|---|---|---|---|---|---|
| 3,293,181 | A | | 12/1966 | Stuart | 252/32.7 |
| 3,396,109 | A | | 8/1968 | Butler et al. | 252/32.7 |
| 3,397,145 | A | | 8/1968 | Cyba | 252/32.7 |
| 3,442,804 | A | | 5/1969 | Le Suer et al. | 252/32.7 |
| 3,637,499 | A | | 1/1972 | Pollak | 252/32.7 |
| 3,853,776 | A | * | 12/1974 | Clark et al. | 508/215 |
| 4,690,688 | A | * | 9/1987 | Adams et al. | 44/320 |
| 4,946,611 | A | * | 8/1990 | Kaneko | 508/203 |
| 5,084,195 | A | | 1/1992 | Camenzind et al. | 252/47.5 |
| 5,300,243 | A | | 4/1994 | Camenzind et al. | 252/47.5 |
| 5,498,809 | A | | 3/1996 | Emert et al. | 585/13 |
| 5,512,190 | A | | 4/1996 | Anderson et al. | 252/47 |
| 5,514,189 | A | | 5/1996 | Farng et al. | 44/383 |
| 5,534,173 | A | * | 7/1996 | Faber et al. | 508/203 |
| 6,001,140 | A | * | 12/1999 | Grabowski et al. | 44/320 |
| 6,191,080 | B1 | * | 2/2001 | Nakanishi et al. | 508/437 |
| 6,372,337 | B2 | * | 4/2002 | Takahashi et al. | 428/328 |
| 6,551,966 | B2 | | 4/2003 | Nalesnik | 508/277 |
| 6,652,608 | B1 | * | 11/2003 | Orr | 44/360 |

* cited by examiner

*Primary Examiner*—Glenn Caldarola
*Assistant Examiner*—Jim Goloboy
(74) *Attorney, Agent, or Firm*—James Sher

(57) ABSTRACT

A composition is disclosed that comprises:
(A) a lubricant or a hydrocarbon fuel, and
(B) at least one polysiloxane of the formula:

$$M_wD'_xD_yM'_z$$

where:
w is 2-z;
x is 0 to 50;
y is 0 to 500;
z is 0 to 2;
$M=Si(CH_3)_3—O—$;
$M'=R^1—Si(CH_3)_2O—$;
$D=—Si(CH_3)_2O—$;
$D'=—Si(CH_3)(R^1)O—$; and
$R^1$ is an aliphatic or aromatic moiety linked to at least one silicon atom from siloxane and comprising at least one heteroatom.

11 Claims, No Drawings

POLYSILOXANE ADDITIVES FOR LUBRICANTS AND FUELS

We claim the benefit under Title 35, United States Code, § 120 to U.S. Provisional Application No. 60/489,688, filed Jul. 22, 2003, entitled POLYSILOXANE ADDITIVES FOR LUBRICANTS AND FUELS.

BACKGROUND OF THE INVENTION

1. Field of the Invention

This invention is related to fuels, especially hydrocarbon fuels, and lubricants, especially lubricating oils, and, more particularly, to a class of non-phosphorus-containing anti-wear, anti-fatigue, and extreme pressure additives that are derived from polysiloxanes for use in such fuels and lubricants.

2. Description of Related Art

In developing lubricating oils, there have been many attempts to provide additives that impart anti-fatigue, anti-wear, and extreme pressure properties thereto. Zinc dialkyldithiophosphates (ZDDP) have been used in formulated oils as anti-wear additives for more than 50 years. However, zinc dialkyldithiophosphates give rise to ash, which contributes to particulate matter in automotive exhaust emissions, and regulatory agencies are seeking to reduce emissions of zinc into the environment. In addition, phosphorus, also a component of ZDDP, is suspected of limiting the service life of the catalytic converters that are used on cars to reduce pollution. It is important to limit the particulate matter and pollution formed during engine use for toxicological and environmental reasons, but it is also important to maintain undiminished the anti-wear properties of the lubricating oil.

In view of the aforementioned shortcomings of the known zinc and phosphorus-containing additives, efforts have been made to provide lubricating oil additives that contain neither zinc nor phosphorus or, at least, contain them in substantially reduced amounts. Illustrative of non-zinc, i.e., ashless, non-phosphorus-containing lubricating oil additives are the reaction products of 2,5-dimercapto-1,3,4-thiadiazoles and unsaturated mono-, di-, and tri-glycerides disclosed in U.S. Pat. No. 5,512,190 and the dialkyl dithiocarbamate-derived organic ethers of U.S. Pat. No. 5,514,189.

U.S. Pat. No. 5,512,190 discloses an additive that provides anti-wear properties to a lubricating oil. The additive is the reaction product of 2,5-dimercapto-1,3,4-thiadiazole and a mixture of unsaturated mono-, di-, and triglycerides. Also disclosed is a lubricating oil additive with anti-wear properties produced by reacting a mixture of unsaturated mono-, di-, and triglycerides with diethanolamine to provide an intermediate reaction product and reacting the intermediate reaction product with 2,5-dimercapto-1,3,4 thiadiazole.

U.S. Pat. No. 5,514,189 discloses that dialkyl dithiocarbamate-derived organic ethers have been found to be effective anti-wear/antioxidant additives for lubricants and fuels.

U.S. Pat. Nos. 5,084,195 and 5,300,243 disclose N-acyl-thiourethane thioureas as anti-wear additives specified for lubricants or hydraulic fluids.

U.S. Pat. No. 6,551,966 discloses a composition comprising:

(A) a lubricant, and (B) at least one 5-alkyl-2-mercapto-1,3,4-oxadiazole compound of the formula:

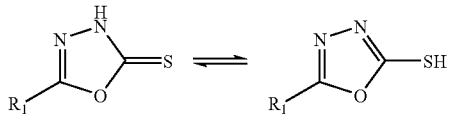

wherein $R_1$ is a hydrocarbon or functionalized hydrocarbon of from 1 to 30 carbon atoms.

U.S. Provisional Application No. 60/394,265 filed Jul. 9, 2002 is directed to a composition comprising:

(A) a lubricant or a hydrocarbon fuel, and (B) at least one silane of the formula:

$$A[Si(R^1)_{3-a}(OR^2)_a]_r$$

wherein

A is a group of valence r, r being an integer greater than or equal to 1, selected from the group consisting of linear, branched, or cyclic hydrocarbon groups, an oxygen atom, or a linear, branched, or cyclic siloxane or polysiloxane group, each of which, except for an oxygen atom, optionally comprises substituents having oxygen, nitrogen, sulfur, or halogen heteroatoms;

$R^1$ is selected from the group consisting of hydrocarbyl, and chain-substituted hydrocarbyl;

$R^2$ is selected from the group consisting of hydrocarbyl and chain-substituted hydrocarbyl; and a is 0, 1, 2, or 3;

provided that if r is 1, A is $R^7Y$, wherein $R^7$ is a divalent linear, branched, or cyclic hydrocarbon group, and Y is hydrogen, halogen, an N-bonded group, an O-bonded group, an S-bonded group, or a C-bonded group, and if r is 2, A can be $R^7$.

Japanese patent publication 8-337788 (Dec. 24, 1996) claims additives consisting of silane compounds, e.g., $R_1Si(OR)_3$, $(R_1)_2Si(OR)_2$, and $(R_1)_3SiOR$(R=H, $C_{1-18}$ alkyl, $C_{2-18}$ alkenyl, $C_{6-18}$ aryl; $R_1$=$C_{6-50}$ alkyl, alkenyl, aryl; the alkyl group in $R_1$ may contain N, O, or S or be substituted with OH, $CO_2H$, alkoxycarbonyl, alkenoxycarbonyl, or aryloxycarbonyl). The lubricating oil compounds contain (1) 0.05-10 wt. % the silane additives or (2) the silane additives, metal detergents, and optionally extreme-pressure agents and ashless dispersants. The additives are said to decrease friction of engine oils and improve piston detergency.

Russian patent 245955 (Jun. 11, 1969) discloses that the antifriction and antiwear properties of mineral oil lubricants are increased by addition of organosilanes. To improve the properties of the lubricants, trialkoxy-organosilanes with various functional groups of the formula $(RO)_3SiR'X$, where RO is an alkoxy group, R' is an alkyl, alkylene, or aryl radical, and X is a functional group, such as $NH_2$, $CO_2H$, COH, OH, or CN, are used.

The disclosures of the foregoing references are incorporated herein by reference in their entirety.

SUMMARY OF THE INVENTION

The present invention is directed to additives that can be used as either partial or complete replacements for the zinc dialkyldithiophosphates currently used. They can also be used in combination with other additives typically found in motor oils, as well as other ashless anti-wear additives. The typical additives found in motor oils include dispersants, detergents, anti-wear agents, extreme pressure agents, rust inhibitors, antioxidants, antifoamants, friction modifiers, Viscosity Index improvers, metal passivators, and pour point depressants.

The compounds employed in the practice of this invention are polysiloxanes that are useful as low ash, non-phosphorus-containing, anti-fatigue, anti-wear, extreme pressure additives for fuels and lubricating oils.

The present invention also relates to lubricating oil compositions comprising a lubricating oil and a functional property-improving amount of at least one polysiloxane.

It is an object of the present invention to provide a new application for polysiloxanes useful either alone or in combination with other lubricant additives. The polysiloxanes in combination with zinc dialkyl dithiophosphate, zinc diaryl dithiophosphate, and/or zinc alkylaryl dithiophosphate are an improvement over the prior art.

The additives of the present invention are especially useful as components in many different lubricating oil compositions. The additives can be included in a variety of oils with lubricating viscosity including natural and synthetic lubricating oils and mixtures thereof. The additives can be included in crankcase lubricating oils for spark-ignited and compression-ignited internal combustion engines. The compositions can also be used in gas engine lubricants, turbine lubricants, automatic transmission fluids, gear lubricants, compressor lubricants, metal-working lubricants, hydraulic fluids, and other lubricating oil and grease compositions. The additives can also be used in motor fuel compositions.

The class of non-phosphorus anti-fatigue, anti-wear, and extreme pressure additives can be organic derivatives of polysiloxanes. Polysiloxanes are characterized by a low surface energy and show a strong tendency to adsorb on interfaces such as metals/oil, liquid/gas, etc. The adsorption capability is defined by the nature of organic groups grafted on polysiloxane, the size of polysiloxane and the density of substitution with organic groups. The careful selection of all these variables permits the tailoring of molecular properties of such organomodified polysiloxane and the control of their behavior on interfaces.

The polysiloxanes can conveniently be modified with various organic groups via the reaction of hydrosilylation. This is the preferred, but not the only, way of introducing organic moieties into polysiloxane. The groups grafted on polysiloxane can contain one or more heteroatoms, such as oxygen, sulphur, or nitrogen. The presence of such elements showing high electronegativity should enhance the affinity of polysiloxane to the metal surfaces.

The class of anti-fatigue, anti-wear, and extreme pressure additives can have the following generic formula:

$$M_wD'_xD_yM'_z$$

where:
w is 2-z;
x is 0 to 50;
y is 0 to 500;
z is 0 to 2;
$M=Si(CH_3)_3—O—$;
$M'=R^1—Si(CH_3)_2O—$;
$D=—Si(CH_3)_2O—$;
$D'=—Si(CH_3)(R^1)O—$; and
$R^1$ is an aliphatic or aromatic moiety linked to at least one silicon atoms from siloxane and comprising heteroatoms, e.g., sulfur or nitrogen.

For example, $R^1$ can be $—R^3—(C_2H_4O)_8OC(O)CH_2CH_2R^2$, where $R^2$ is an aliphatic or aromatic radical, such as $C_1$ to $C_{30}$, benzyl, and the like, or $R^1$ can be $(R^3)OC(O)CH_2CH_2SCH_2CH_2OC(O)(R^3)$, where $R^3$ is an aromatic or aliphatic radical bearing a group reacting with the siloxane backbone. A typical example of $R^3$ is an allyl radical capable of reacting with a siloxane hydride corresponding to the formulae above.

More particularly, the present invention is directed to a composition comprising:

(A) a lubricant or a hydrocarbon fuel, and (B) at least one silane of the formula:

$$M_wD'_xD_yM'_z$$

where:
w is 2-z;
x is 0 to 50;
y is 0 to 500;
z is 0 to 2;
$M=Si(CH_3)_3—O—$;
$M'=R^1—Si(CH_3)_2O—$;
$D=—Si(CH_3)_2O—$;
$D'=—Si(CH_3)(R^1)O—$; and
$R^1$ is an aliphatic or aromatic moiety linked to at least one silicon atom from siloxane and comprising at least one heteroatom.

In another aspect, the present invention is directed to a method for improving the anti-fatigue, anti-wear, and extreme pressure properties of a lubricant or a hydrocarbon fuel comprising adding thereto at least one polysiloxane of the formula:

$$M_wD'_xD_yM'_z$$

where:
w is 2-z;
x is 0 to 50;
y is 0 to 500;
z is 0 to 2;
$M=Si(CH_3)_3—O—$;
$M'=R^1—Si(CH_3)_2O—$;
$D=—Si(CH_3)_2O—$;
$D'=—Si(CH_3)(R^1)O—$; and
$R^1$ is an aliphatic or aromatic moiety linked to at least one silicon atom from siloxane and comprising at least one heteroatom.

It is preferred that the silane be present in the compositions of the present invention in a concentration in the range of from about 0.01 to about 10 wt %.

DESCRIPTION OF THE PREFERRED EMBODIMENTS

As stated above, the class of anti-fatigue, anti-wear, and extreme pressure additives can have the following generic formula:

$$M_wD'_xD_yM'_z$$

where:
w is 2-z;
x is 0 to 50;
y is 0 to 500;
z is 0 to 2;
$M=Si(CH_3)_3—O—$;
$M'=R^1—Si(CH_3)_2O—$;
$D=—Si(CH_3)_2O—$;
$D'=—Si(CH_3)(R^1)O—$; and
$R^1$ is an aliphatic or aromatic moiety linked to at least one silicon atom from siloxane and comprising at least one heteroatom.

Preferably, the class of anti-fatigue, anti-wear, and extreme pressure additives of the present invention has the following structure:

$$M_wD'_xD_yM'_z$$

wherein:

w is 2 or 0;

x+y is from 0 to 15;

z is 0 or 2; and $R^1$ is an aliphatic thio moiety derived from thiopropionic acid.

The use of the polysiloxanes of this invention can improve the anti-fatigue, anti-wear, and extreme pressure properties of a lubricant.

Use with other Additives

The polysiloxane additives of this invention can be used as either a partial or complete replacement for the zinc dialkyldithiophosphates currently used. They can also be used in combination with other additives typically found in lubricating oils, as well as with other antiwear additives. The additives typically found in lubricating oils are, for example, dispersants, detergents, corrosion/rust inhibitors, antioxidants, anti-wear agents, anti-foamants, friction modifiers, seal swell agents, demulsifiers, VI improvers, pour point depressants, and the like. See, for example, U.S. Pat. No. 5,498,809 for a description of useful lubricating oil composition additives, the disclosure of which is incorporated herein by reference in its entirety.

Examples of dispersants include polyisobutylene succinimides, polyisobutylene succinate esters, Mannich Base ashless dispersants, and the like. Examples of detergents include metallic and ashless alkyl phenates, metallic and ashless sulfurized alkyl phenates, metallic and ashless alkyl sulfonates, metallic and ashless alkyl salicylates, metallic and ashless saligenin derivatives, and the like.

Examples of antioxidants include alkylated diphenylamines, N-alkylated phenylenediamines, phenyl-α-naphthylamine, alkylated phenyl-α-naphthylamine, dimethyl quinolines, trimethyldihydroquinolines and oligomeric compositions derived therefrom, hindered phenolics, alkylated hydroquinones, hydroxylated thiodiphenyl ethers, alkylidenebisphenols, thiopropionates, metallic dithiocarbamates, 1,3,4-dimercaptothiadiazole and derivatives, oil soluble copper compounds, and the like. The following are exemplary of such additives and are commercially available from Crompton Corporation: Naugalube® 438, Naugalube 438L, Naugalube 640, Naugalube 635, Naugalube 680, Naugalube AMS, Naugalube APAN, Naugard PANA, Naugalube TMQ, Naugalube 531, Naugalube 431, Naugard® BHT, Naugalube 403, and Naugalube 420, among others.

Examples of anti-wear additives that can be used in combination with the additives of the present invention include organo-borates, organo-phosphites, organo-phosphates, organic sulfur-containing compounds, sulfurized olefins, sulfurized fatty acid derivatives (esters), chlorinated paraffins, zinc dialkyldithiophosphates, zinc diaryldithiophosphates, phosphosulfurized hydrocarbons, and the like. The following are exemplary of such additives and are commercially available from The Lubrizol Corporation: Lubrizol 677A, Lubrizol 1095, Lubrizol 1097, Lubrizol 1360, Lubrizol 1395, Lubrizol 5139, and Lubrizol 5604, among others.

Examples of friction modifiers include fatty acid esters and amides, organo molybdenum compounds, molybdenum dialkyldithiocarbamates, molybdenum dialkyl dithiophosphates, molybdenum disulfide, tri-molybdenum cluster dialkyldithiocarbamates, non-sulfur molybdenum compounds and the like. The following are exemplary of such additives and are commercially available from R. T. Vanderbilt Company, Inc.: Molyvan A, Molyvan L, Molyvan 807, Molyvan 856B, Molyvan 822, Molyvan 855, among others. The following are also exemplary of such additives and are commercially available from Asahi Denka Kogyo K.K.: SAKURA-LUBE 100, SAKURA-LUBE 165, SAKURA-LUBE 300, SAKURA-LUBE 310G, SAKURA-LUBE 321, SAKURA-LUBE 474, SAKURA-LUBE 600, SAKURA-LUBE 700, among others. The following are also exemplary of such additives and are commercially available from Akzo Nobel Chemicals GmbH: Ketjen-Ox 77M, Ketjen-Ox 77TS, among others.

An example of an anti-foamant is polysiloxane, and the like. Examples of rust inhibitors are polyoxyalkylene polyol, benzotriazole derivatives, and the like. Examples of VI improvers include olefin copolymers and dispersant olefin copolymers, and the like. An example of a pour point depressant is polymethacrylate, and the like.

As noted above, suitable anti-wear compounds include dihydrocarbyl dithiophosphates. Preferably, the hydrocarbyl groups contain an average of at least 3 carbon atoms. Particularly useful are metal salts of at least one dihydrocarbyl dithiophosphoric acid wherein the hydrocarbyl groups contain an average of at least 3 carbon atoms. The acids from which the dihydrocarbyl dithiophosphates can be derived can be illustrated by acids of the formula:

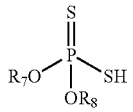

wherein $R_7$ and $R_8$ are the same or different and are alkyl, cycloalkyl, aralkyl, alkaryl, or substituted substantially hydrocarbon radical derivatives of any of the above groups, and wherein the $R_7$ and $R_8$ groups in the acid each have, on average, at least 3 carbon atoms. By "substantially hydrocarbon" is meant radicals containing substituent groups, e.g., 1 to 4 substituent groups per radical moiety, such as ether, ester, nitro, or halogen, that do not materially affect the hydrocarbon character of the radical.

Specific examples of suitable $R_7$ and $R_8$ radicals include isopropyl, isobutyl, n-butyl, sec-butyl, n-hexyl, heptyl, 2-ethylhexyl, diisobutyl, isooctyl, decyl, dodecyl, tetradecyl, hexadecyl, octadecyl, butylphenyl, o,p-dipentylphenyl, octylphenyl, polyisobutene-(molecular weight 350)-substituted phenyl, tetrapropylene-substituted phenyl, beta-octylbutylnaphthyl, cyclopentyl, cyclohexyl, phenyl, chlorophenyl, o-dichlorophenyl, bromophenyl, naphthenyl, 2-methylcyclohexyl, benzyl, chlorobenzyl, chloropentyl, dichlorophenyl, nitrophenyl, dichlorodecyl and xenyl radicals. Alkyl radicals having from about 3 to about 30 carbon atoms and aryl radicals having from about 6 to about 30 carbon atoms are preferred. Particularly preferred $R_7$ and $R_8$ radicals are alkyl of from 4 to 18 carbon atoms.

The phosphorodithioic acids are readily obtainable by the reaction of phosphorus pentasulfide and an alcohol or phenol. The reaction involves mixing, at a temperature of about 20° C. to 200° C., 4 moles of the alcohol or phenol with one mole of phosphorus pentasulfide. Hydrogen sulfide is liberated as the reaction takes place. Mixtures of alcohols, phenols, or both can be employed, e.g., mixtures of $C_3$ to $C_{30}$ alcohols, $C_6$ to $C_{30}$ aromatic alcohols, etc.

The metals useful to make the phosphate salts include Group I metals, Group II metals, aluminum, lead, tin, molybdenum, manganese, cobalt, and nickel. Zinc is the preferred metal. Examples of metal compounds that can be reacted with the acid include lithium oxide, lithium hydroxide, lithium carbonate, lithium pentylate, sodium oxide, sodium hydroxide, sodium carbonate, sodium methylate, sodium propylate, sodium phenoxide, potassium oxide, potassium hydroxide, potassium carbonate, potassium methylate, silver oxide, silver carbonate, magnesium oxide, magnesium hydroxide, magnesium carbonate, magnesium ethylate, magnesium propylate, magnesium phenoxide, calcium oxide, calcium hydroxide, calcium carbonate, calcium methylate, calcium propylate, calcium pentylate, zinc oxide, zinc hydroxide, zinc carbonate, zinc propylate, strontium oxide, strontium hydroxide, cadmium oxide, cadmium hydroxide, cadmium carbonate, cadmium ethylate, barium oxide, barium hydroxide, barium hydrate, barium carbonate, barium ethylate, barium pentylate, aluminum oxide, aluminum propylate, lead oxide, lead hydroxide, lead carbonate, tin oxide, tin butylate, cobalt oxide, cobalt hydroxide, cobalt carbonate, cobalt pentylate, nickel oxide, nickel hydroxide, and nickel carbonate.

In some instances, the incorporation of certain ingredients, particularly carboxylic acids or metal carboxylates, such as, small amounts of the metal acetate or acetic acid, used in conjunction with the metal reactant will facilitate the reaction and result in an improved product. For example, the use of up to about 5% of zinc acetate in combination with the required amount of zinc oxide facilitates the formation of a zinc phosphorodithioate.

The preparation of metal phosphorodithioates is well known in the art and is described in a large number of issued patents, including U.S. Pat. Nos. 3,293,181; 3,397,145; 3,396,109; and 3,442,804; the disclosures of which are hereby incorporated by reference. Also useful as anti-wear additives are amine derivatives of dithiophosphoric acid compounds, such as are described in U.S. Pat. No. 3,637,499, the disclosure of which is hereby incorporated by reference in its entirety.

The zinc salts are most commonly used as anti-wear additives in lubricating oil in amounts of 0.1 to 10, preferably 0.2 to 2, wt. %, based upon the total weight of the lubricating oil composition. They may be prepared in accordance with known techniques by first forming a dithiophosphoric acid, usually by reaction of an alcohol or a phenol with $P_2S_5$ and then neutralizing the dithiophosphoric acid with a suitable zinc compound.

Mixtures of alcohols can be used, including mixtures of primary and secondary alcohols, secondary generally for imparting improved antiwear properties and primary for thermal stability. In general, any basic or neutral zinc compound could be used, but the oxides, hydroxides, and carbonates are most generally employed. Commercial additives frequently contain an excess of zinc owing to use of an excess of the basic zinc compound in the neutralization reaction.

The zinc dihydrocarbyl dithiophosphates (ZDDP) are oil soluble salts of dihydrocarbyl esters of dithiophosphoric acids and can be represented by the following formula:

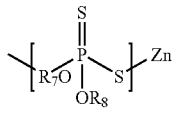

wherein $R_7$ and $R_8$ are as described in connection with the previous formula.

Lubricant Compositions

Compositions, when they contain these additives, are typically blended into a base oil in amounts such that the additives therein are effective to provide their normal attendant functions. Representative effective amounts of such additives are illustrated in TABLE 1.

TABLE 1

| Additives | Preferred Weight % | More Preferred Weight % |
|---|---|---|
| V.I. Improver | 1-12 | 14 |
| Corrosion Inhibitor | 0.01-3 | 0.01-1.5 |
| Oxidation Inhibitor | 0.01-5 | 0.01-1.5 |
| Dispersant | 0.1-10 | 0.1-5 |
| Lube Oil Flow Improver | 0.01-2 | 0.01-1.5 |
| Detergent/Rust Inhibitor | 0.01-6 | 0.01-3 |
| Pour Point Depressant | 0.01-1.5 | 0.01-0.5 |
| Anti-foaming Agents | 0.001-0.1 | 0.001-0.01 |
| Anti-wear Agents | 0.001-5 | 0.001-1.5 |
| Seal Swell Agents | 0.1-8 | 0.1-4 |
| Friction Modifiers | 0.01-3 | 0.01-1.5 |
| Lubricating Base Oil | Balance | Balance |

When other additives are employed, it may be desirable, although not necessary, to prepare additive concentrates comprising concentrated solutions or dispersions of the subject additives of this invention (in concentrate amounts hereinabove described), together with one or more of said other additives (said concentrate when constituting an additive mixture being referred to herein as an additive-package) whereby several additives can be added simultaneously to the base oil to form the lubricating oil composition. Dissolution of the additive concentrate into the lubricating oil can be facilitated by solvents and by mixing accompanied by mild heating, but this is not essential. The concentrate or additive-package will typically be formulated to contain the additives in proper amounts to provide the desired concentration in the final formulation when the additive-package is combined with a predetermined amount of base lubricant. Thus, the subject additives of the present invention can be added to small amounts of base oil or other compatible solvents along with other desirable additives to form additive-packages containing active ingredients in collective amounts of, typically, from about 2.5 to about 90 percent, preferably from about 15 to about 75 percent, and more preferably from about 25 percent to about 60 percent by weight additives in the appropriate proportions with the remainder being base oil. The final formulations can typically employ about 1 to 20 weight percent of the additive-package with the remainder being base oil.

All of the weight percentages expressed herein (unless otherwise indicated) are based on the active ingredient (AI) content of the additive, and/or upon the total weight of any additive-package, or formulation, which will be the sum of the AI weight of each additive plus the weight of total oil or diluent.

In general, the lubricant compositions of the invention contain the additives in a concentration ranging from about 0.05 to about 30 weight percent. A concentration range for the additives ranging from about 0.1 to about 10 weight percent based on the total weight of the oil composition is preferred. A more preferred concentration range is from about 0.2 to about 5 weight percent. Oil concentrates of the additives can contain from about 1 to about 75 weight percent of the additive reaction product in a carrier or diluent oil of lubricating oil viscosity.

In general, the additives of the present invention are useful in a variety of lubricating oil base stocks. The lubricating oil base stock is any natural or synthetic lubricating oil base stock fraction having a kinematic viscosity at 100° C. of about 2 to about 200 cSt, more preferably about 3 to about 150 cSt, and most preferably about 3 to about 100 cSt. The lubricating oil base stock can be derived from natural lubricating oils, synthetic lubricating oils, or mixtures thereof Suitable lubricating oil base stocks include base stocks obtained by isomerization of synthetic wax and wax, as well as hydrocracked base stocks produced by hydrocracking (rather than solvent extracting) the aromatic and polar components of the crude. Natural lubricating oils include animal oils, such as lard oil, vegetable oils (e.g., canola oils, castor oils, sunflower oils), petroleum oils, mineral oils, and oils derived from coal or shale.

Synthetic oils include hydrocarbon oils and halo-substituted hydrocarbon oils, such as polymerized and interpolymerized olefins, alkylbenzenes, polyphenyls, alkylated diphenyl ethers, alkylated diphenyl sulfides, as well as their derivatives, analogs, homologs, and the like. Synthetic lubricating oils also include alkylene oxide polymers, interpolymers, copolymers, and derivatives thereof, wherein the terminal hydroxyl groups have been modified by esterification, etherification, etc.

Another suitable class of synthetic lubricating oils comprises the esters of dicarboxylic acids with a variety of alcohols. Esters useful as synthetic oils also include those made from $C_5$ to $C_{12}$ monocarboxylic acids and polyols and polyol ethers. Other esters useful as synthetic oils include those made from copolymers of α-olefins and dicarboxylic acids which are esterified with short or medium chain length alcohols. The following are exemplary of such additives and are commercially available from Akzo Nobel Chemicals SpA: Ketjenlubes 115, 135, 165, 1300, 2300, 2700, 305, 445, 502, 522, and 6300, among others.

Silicon-based oils, such as the polyalkyl-, polyaryl-, polyalkoxy-, or polyaryloxy-siloxane oils and silicate oils, comprise another useful class of synthetic lubricating oils. Other synthetic lubricating oils include liquid esters of phosphorus-containing acids, polymeric tetrahydrofurans, poly α-olefins, and the like.

The lubricating oil may be derived from unrefined, refined, re-refined oils, or mixtures thereof Unrefined oils are obtained directly from a natural source or synthetic source (e.g., coal, shale, or tar and bitumen) without further purification or treatment. Examples of unrefined oils include a shale oil obtained directly from a retorting operation, a petroleum oil obtained directly from distillation, or an ester oil obtained directly from an esterification process, each of which is then used without further treatment. Refined oils are similar to unrefined oils, except that refined oils have been treated in one or more purification steps to improve one or more properties. Suitable purification techniques include distillation, hydrotreating, dewaxing, solvent extraction, acid or base extraction, filtration, percolation, and the like, all of which are well-known to those skilled in the art. Re-refined oils are obtained by treating refined oils in processes similar to those used to obtain the refined oils. These re-refined oils are also known as reclaimed or reprocessed oils and often are additionally processed by techniques for removal of spent additives and oil breakdown products.

Lubricating oil base stocks derived from the hydroisomerization of wax may also be used, either alone or in combination with the aforesaid natural and/or synthetic base stocks. Such wax isomerate oil is produced by the hydroisomerization of natural or synthetic waxes or mixtures thereof over a hydroisomerization catalyst. Natural waxes are typically the slack waxes recovered by the solvent dewaxing of mineral oils; synthetic waxes are typically the wax produced by the Fischer-Tropsch process. The resulting isomerate product is typically subjected to solvent dewaxing and fractionation to recover various fractions having a specific viscosity range. Wax isomerate is also characterized by possessing very high viscosity indices, generally having a VI of at least 130, preferably at least 135 or higher and, following dewaxing, a pour point of about −20° C. or lower.

The additives of the present invention are especially useful as components in many different lubricating oil compositions. The additives can be included in a variety of oils with lubricating viscosity, including natural and synthetic lubricating oils and mixtures thereof The additives can be included in crankcase lubricating oils for spark-ignited and compression-ignited internal combustion engines. The compositions can also be used in gas engine lubricants, turbine lubricants, automatic transmission fluids, gear lubricants, compressor lubricants, metal-working lubricants, hydraulic fluids, and other lubricating oil and grease compositions. The additives can also be used in motor fuel compositions.

The advantages and the important features of the present invention will be more apparent from the following examples.

EXAMPLES

Anti-Wear Four-Ball Testing

The anti-wear properties of the siloxanes in a fully formulated lubricating oil were determined in the Four-Ball Wear Test under the ASTM D 4172 test conditions. The testing for these examples was done on a Falex Variable Drive Four-Ball Wear Test Machine. Four balls are arranged in an equilateral tetrahedron. The lower three balls are clamped securely in a test cup filled with lubricant and the upper ball is held by a chuck that is motor-driven. The upper ball rotates against the fixed lower balls. Load is applied in an upward direction through a weight/lever arm system. Loading is through a continuously variable pneumatic loading system. Heaters allow operation at elevated oil temperatures. The three stationary steel balls are immersed in 10 milliliters of sample to be tested, and the fourth steel ball is rotated on top of the three stationary balls in "point-to-point contact." The machine is operated for one hour at 75° C. with a load of 40 kilograms and a rotational speed of 1,200 revolutions per minute. The fully formulated lubricating oil contained all the additives typically found in a motor oil (with different anti-wear agents as noted in TABLE 2) as well as 0.5 wt. % cumene hydroperoxide to help simulate the environment within a running engine. The additives were tested for effectiveness in a motor oil formulation and compared to identical formulations with no antiwear additive and with zinc dialkyldithiophosphate.

Example 1

$M'D_8M'$ where the $R^1$ Moiety was Created in a Two Step Process

In a first step, a polysiloxane containing two terminal silicon hydride groups and described as an average statistical structure: $M'D_8M'$ was reacted initially with trimethylolpropane monoallyl ether (TMPMAE). The reaction was catalyzed by chloroplatinic acid.

The product of this reaction, which contains four terminal primary hydroxyl groups derived from TMPMAE, was further transesterified with the methyl ester of laurylthio propionic acid with the continuous elimination of methanol. Butyl tin acetate was used as the catalyst and the reaction was carried out at 165° C.

Example 2

$M'D_{12}M'$ where $R^1$ was Created in a Two Step Process

The statistical silicone hydride equilibrate of the formula $M'D_{12}M'$ was reacted with an allyl group terminated polyether of the average structure CH2═CH—$CH_2$—O$(CH_2CH_2O)_8H$. The resulting copolymer, having terminal hydroxyl groups attached to polyether, was further esterified with thio, bis propionic acid with the continuous removal of water. About 75% conversion was achieved further to the amount of water removed.

A linear copolymer with segments of polysiloxane, thiopropionic radicals and polyethers was produced.

Example 3

$(MD'M)_2$

A polyether as in Example 2 was hydrosilylated with a trisiloxane hydride described by the formula $(MD'M)_2$. The derivative thus prepared contains one hydroxyl group associated with polyether. In a second step, thio,bis propionic acid was used to esterify available hydroxyls and about 80% conversion was achieved. A thioester of a polyether terminated with trisiloxane was produced.

The reaction order can be reversed. Thus, thio, bis propionic acid can react with two moles of polyether mono-alcohol terminated with an allyl group. Such a di-ester with two terminal allyl groups (group $R^1$) can further be hydrosilylated with trisiloxane hydride or another silicon hydride.

TABLE 2

Four-Ball Wear Results

| Compound | Average Wear Scar Diameter, mm |
|---|---|
| $(MD'M)_2$ | 0.36 |
| $M'D_{12}M'$ | 0.40 |
| $M'D_8M'$ | 0.37 |
| No antiwear additive | 0.85 |
| Zinc dialkyldithiophosphate | 0.47 |

In view of the many changes and modifications that can be made without departing from principles underlying the invention, reference should be made to the appended claims for an understanding of the scope of the protection to be afforded the invention.

What is claimed is:

1. A composition comprising:

(A) a lubricant or a hydrocarbon fuel, and (B) at least one polysiloxane selected from the group consisting of polysiloxanes of the formulae $(MD'M)_2$ and $M'D_yM'$ where:

y is 1 to 15;

$M=Si(CH_3)_3$—O—;

$M'=R^1$—$Si(CH_3)_2O$—;

D=—$Si(CH_3)_2O$—;

D'=—$Si(CH_3)(R^1)O$—; and $R^1$ is $R^3$—$(C_2H_4O)_8OC(O)CH_2CH_2R^2$ or $(R^3)OC(O)CH_2CH_2SCH_2CH_2OC(O)(R^3)$, where $R^2$ is an aliphatic or aromatic radical and $R^3$ is an aromatic or aliphatic radical bearing a group reacting with the siloxane backbone.

2. The composition of claim 1 further comprising at least one additional additive selected from the group consisting of dispersants, detergents, rust inhibitors, antioxidants, metal deactivators, anti-wear agents, extreme pressure agents, anti-foamants, friction modifiers, seal swell agents, demulsifiers, Viscosity Index improvers, and pour point depressants.

3. The composition of claim 1 further comprising at least one additional additive selected from the group consisting of zinc dialkyldithiophosphate, zinc diaryldithiophosphate, and zinc alkylaryldithiophosphate.

4. The composition of claim 1 wherein the lubricant is a lubricating oil.

5. A composition comprising:

(A) a lubricant, and (B) at least one polysiloxane selected from the group consisting of polysiloxanes of the formulae $(MD'M)_2$ and $M'D_yM'$ where:

y is 1 to 15;

$M=Si(CH_3)_3$—O—;

$M'=R^1$—$Si(CH_3)_2O$—;

D=—$Si(CH_3)_2O$—;

D'=—$Si(CH_3)(R^1)O$—; and $R^1$ is $R^3$—$(C_2H_4O)_8OC(O)CH_2CH_2R^2$ or $(R^3)OC(O)CH_2CH_2SCH_2CH_2OC(O)(R^3)$, where $R^2$ is an aliphatic or aromatic radical and $R^3$ is an aromatic or aliphatic radical bearing a group reacting with the siloxane backbone.

6. The composition of claim 5 further comprising at least one additional additive selected from the group consisting of dispersants, detergents, rust inhibitors, antioxidants, metal deactivators, anti-wear agents, extreme pressure agents, anti-foamants, friction modifiers, seal swell agents, demulsifiers, Viscosity Index improvers, and pour point depressants.

7. The composition of claim 5 further comprising at least one additional additive selected from the group consisting of zinc dialkyldithiophosphate, zinc diaryldithiophosphate, and zinc alkylaryldithiophosphate.

8. The composition of claim 5 wherein the lubricant is a lubricating oil.

9. A composition comprising:

(A) a hydrocarbon fuel, and (B) at least one polysiloxane selected from the group consisting of polysiloxanes of the formulae $(MD'M)_2$ and $M'D_yM'$ where:

y is 1 to 15;

$M=Si(CH_3)_3$—O—;

$M'=R^1$—$Si(CH_3)_2O$—;

D=—$Si(CH_3)_2O$—;

D'=—$Si(CH_3)(R^1)O$—; and $R^1$ is $R^3$—$(C_2H_4O)_8OC(O)CH_2CH_2R^2$ or $(R^3)OC(O)CH_2CH_2SCH_2CH_2OC(O)(R^3)$ where $R^2$ is an aliphatic or aromatic radical and $R^3$ is an aromatic or aliphatic radical bearing a group reacting with the siloxane backbone.

10. A method for improving the anti-fatigue, anti-wear, and extreme pressure properties of a lubricant or a hydrocarbon fuel comprising adding thereto at least one polysiloxane selected from the group consisting of polysiloxanes of the formulae $(MD'M)_2$ and $M'D_yM'$ where:

y is 1 to 15;

$M{=}Si(CH_3)_3{-}O{-}$;

$M'{=}R^1{-}Si(CH_3)_2O{-}$;

$D{=}{-}Si(CH_3)_2O{-}$;

$D'{=}{-}Si(CH_3)(R^1)O{-}$; and $R^1$ is $R^3{-}(C_2H_4O)_8OC(O)CH_2CH_2R^2$ or $(R^3)OC(O)CH_2CH_2SCH_2CH_2OC(O)(R^3)$, where $R^2$ is an aliphatic or aromatic radical and $R^3$ is an aromatic or aliphatic radical bearing a group reacting with the siloxane backbone.

11. The method of claim 10 wherein the lubricant is a lubricating oil.

* * * * *